United States Patent [19]

Winter et al.

[11] 4,146,141

[45] Mar. 27, 1979

[54] DISPLAY SYSTEM

[76] Inventors: Russell K. Winter, 252 King George St., Annapolis, Md. 21401; Thomas D. Harvey, 4110 Thornapple St., Chevy Chase, Md. 20015; John W. Harvey, 6572 Sweet Fern, Columbia, Md. 21045; Joseph H. Snively, 252 King George St., Annapolis, Md. 21401; Alexander J. Haill, 3802 Glen Ave., Baltimore, Md. 21215; Mahmut N. Savas, 4701 Willard Ave., Chevy Chase, Md. 20015

[21] Appl. No.: 759,989

[22] Filed: Jan. 17, 1977

[51] Int. Cl.[2] ..... A47F 5/10

[52] U.S. Cl. ..... 211/208; 211/123; 211/204

[58] Field of Search ..... 211/123, 105.1, 105.2, 211/119.1, 195, 201, 204, 208, 206, 189, 190, 191, 113; 160/351; 135/5 B; 248/250, 257

[56] References Cited

U.S. PATENT DOCUMENTS

| | | | |
|---|---|---|---|
| 2,233,725 | 3/1941 | Begin et al. | 211/119.1 X |
| 2,492,517 | 12/1949 | Bernick | 211/105.1 X |
| 2,627,980 | 2/1953 | Schwarz | 211/204 X |
| 2,963,173 | 12/1960 | Barnes | 211/189 |
| 3,119,496 | 1/1964 | Burk | 211/105.1 |
| 3,272,344 | 9/1966 | Sugden | 211/191 X |
| 3,303,938 | 2/1967 | Solomon | 211/206 X |
| 3,349,923 | 10/1967 | Feder | 211/123 |
| 3,568,852 | 3/1971 | Howard | 211/113 |
| 3,722,702 | 3/1973 | Marker | 211/204 |
| 3,984,002 | 10/1976 | Howard | 211/113 X |
| 3,991,884 | 11/1976 | DeMaagd et al. | 211/105.1 X |

*Primary Examiner*—Roy D. Frazier
*Assistant Examiner*—Robert W. Gibson, Jr.
*Attorney, Agent, or Firm*—Morton J. Rosenberg

[57] ABSTRACT

An improved display system for maximizing the display surface of garments visually seen by a customer. The improved display system includes at least a pair of planar members displaced each from the other in parallel relation. The planar members are connected each to the other by a hanger support device which is mounted on opposing ends thereof to the planar members and form an acute angle between the extended length of the hanger support device and each of the opposing planar members. The entire structure provides for a parallelogram geometry which allows the garments hung thereon to have a cascading effect which results in an extended visual area of a series of garments which are being exhibited.

7 Claims, 7 Drawing Figures

FIG. 1
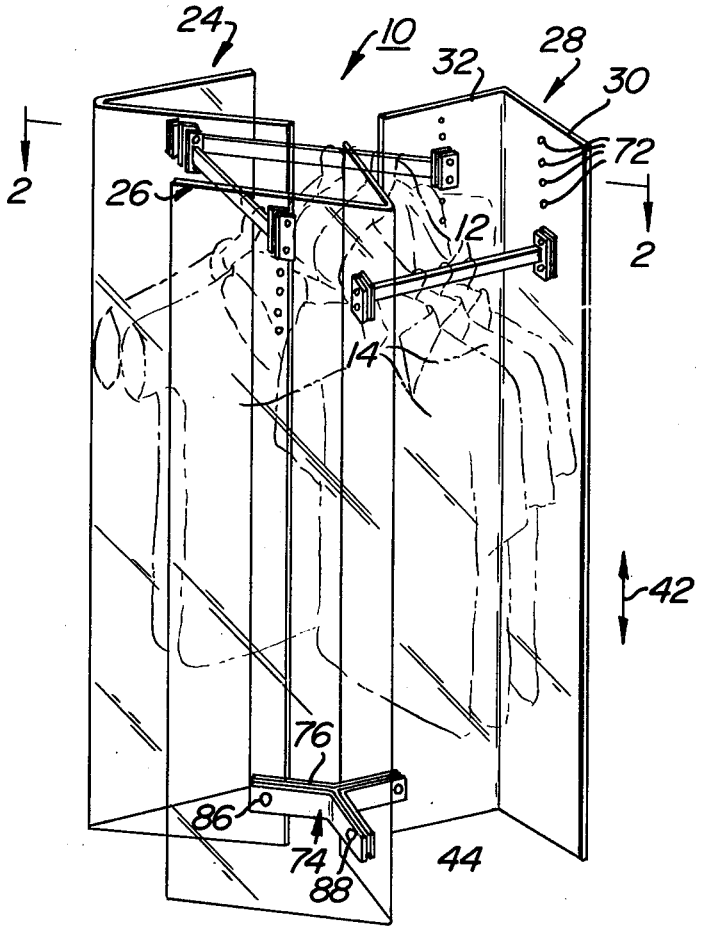
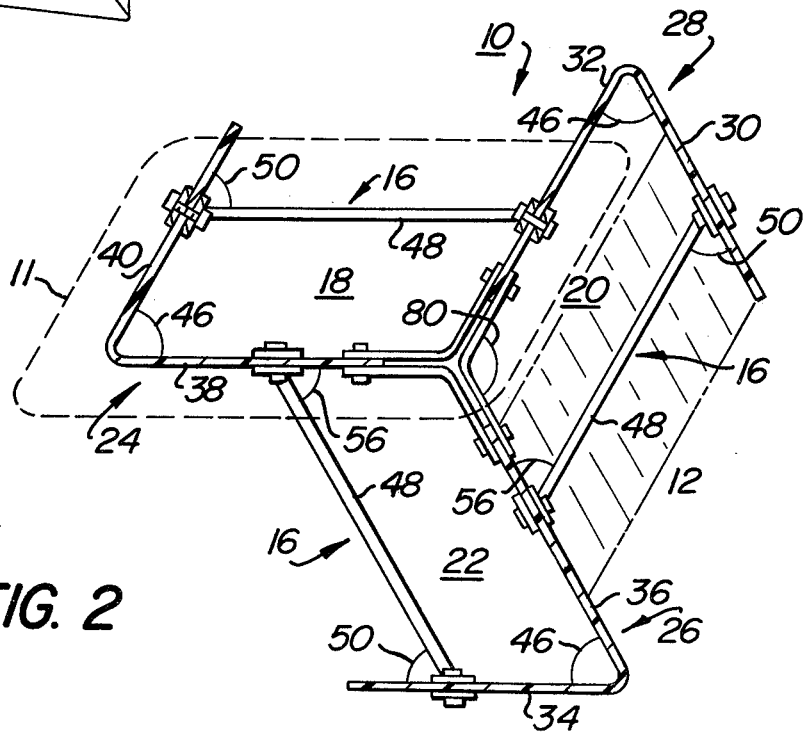
FIG. 2

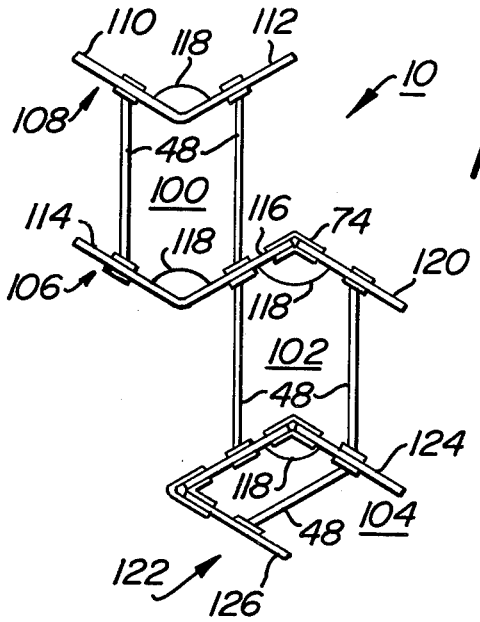
FIG. 5
FIG. 6
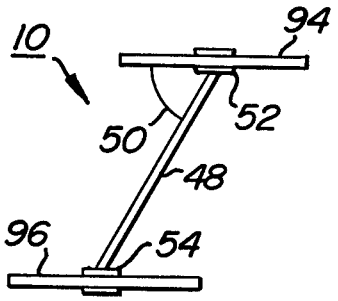
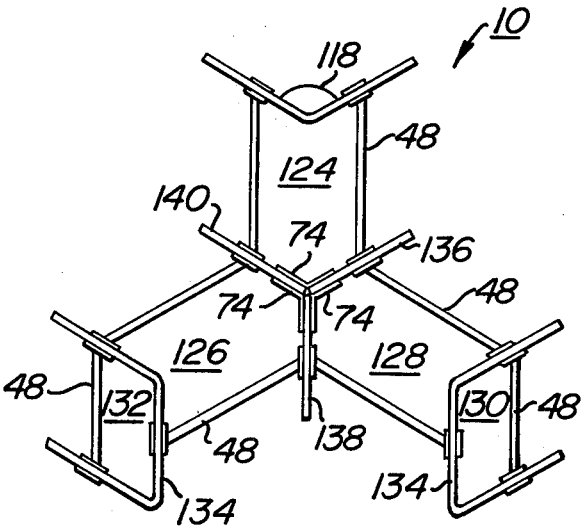
FIG. 7

DISPLAY SYSTEM

BACKGROUND OF THE INVENTION

1. FIELD OF THE INVENTION

This invention pertains to display systems. In particular this invention relates to improved display systems for exhibiting objects which are removeably mounted to the system. Still further this invention pertains to an improved display system which is constructed in a manner to maximize the display surfaces of garments presented thereon. More in particular, this invention relates to improved display systems formed into a parallelogram type structure such that the garments hung thereon are formed into a cascading effect. More in particular, this invention relates to an improved display system having an overall parallelogram type geometric structure and further including transparent end walls for further maximizing the visual display. Additionally, this invention relates to improved display systems which can be formed into a plurality of compartments where the user has a line of sight through the compartments formed.

2. PRIOR ART

Display systems for exhibiting garments hung thereon are well known in the art. However, in some prior display systems, the hanger rail is mounted between opposing end plates and intersect the end plates in a perpendicular fashion. When garments are hung on the hanger rail, they align themselves in substantially parallel relation to the end plates. Thus, the visual surface of each garment is restricted and does not provide the customer with a wide visual range of garment surface areas.

In other prior display systems, garments are hung on radial spokes which extend from a central location. However, in such prior display systems, the garments are once again found to align themselves in the radial direction each with respect to the other. Thus, there is no cascading effect to maximize the surface area of a plurality of garments being hung thereon.

In other prior display systems, such as those commercially known as four way or quad rack type display systems, the customer approaching such a prior system is able to view a frontal plane of the garment in each of the quadrants that make up the display system. However, once again, this prior type display system does not provide for a cascading effect of garments hung in one quadrant of such a system which minimizes the display surface available to the viewer.

SUMMARY OF THE INVENTION

An improved display system for receiving garment hangers having garments mounted thereon. The display system includes at least a pair of displaced planar members positionally located parallel each to the other. A hanger support mechanism having an extended length is secured on opposing ends thereof to each of the planar members and is adapted to skew a plane of the garment hangers with respect to the extended length of the hanger support device.

BRIEF DESCRIPTION OF THE DRAWINGS

FIG. 1 is a perspective view of one form of the improved display system showing three compartments;

FIG. 2 is a plane view of the improved display system shown in FIG. 1 taken in section along the section lines 2—2 of FIG. 1;

FIG. 5 is an embodiment of the improved display system showing a three compartment system utilizing planar members having an obtuse angle formed therebetween;

FIG. 6 is a basic form of the improved display system showing the parallelogram type structure; and, FIG. 7 is a plane view of another form of the improved display system showing a five compartment structure utilizing the parallelogram type construction.

DESCRIPTION OF THE PREFERRED EMBODIMENTS

Figures 3, 4:
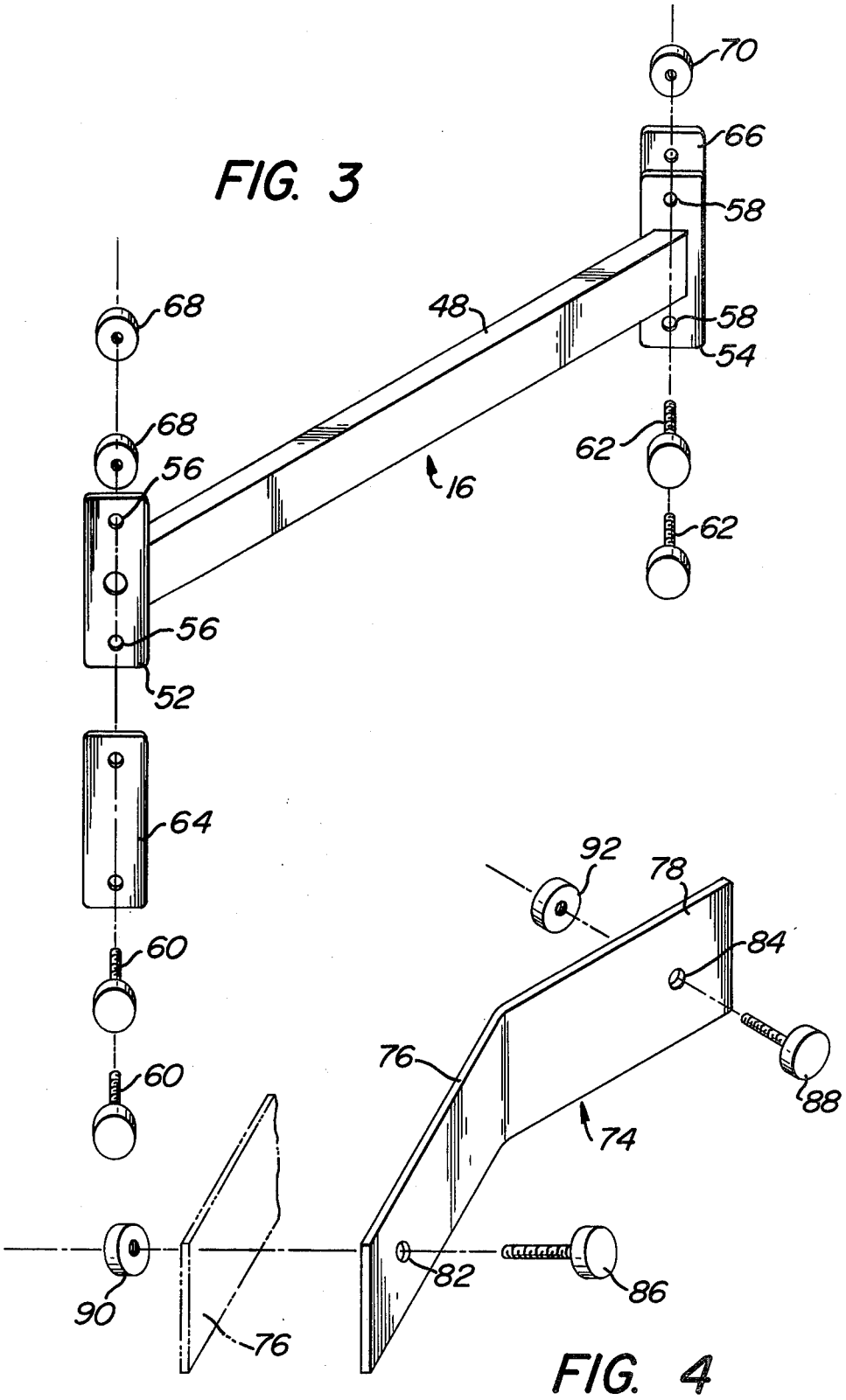
FIG. 3 is a perspective view of the hanger support mechanism which is mounted between opposing parallel planar members.
FIG. 4 is a perspective view of a support mounting bracket for the improved display system.

Referring now to FIGS. 1–4 there is shown display system 10 for exhibiting garments 14 or other objects removeably mounted to system 10 by hangers 12. In overall concept, improved display system 10 is provided in order to effect a maximization of the visually apparent portions of garments 14 displayed thereon as well as to esthetically improve an overall display. In particular, display system 10 is constructed such that garments 14 hung thereon will provide a cascading or waterfall effect to a customer in order that the customer is made apparent of an increased selection set of garments 14. From the unique construction of display system 10, an increased display surface of each garment 14 is visually seen by the customer and in general a more pleasing display is provided.

In broad concept, improved display system 10 is directed to provide a parallelogram type structure shown in FIG. 2 within the dashed line contour 11, which includes opposing parallel end walls connected by a hanger support device joined together in a predetermined geometrical relationship. The opposing parallel end walls may be members of different compartments as shown in the embodiments of FIGS. 1, 2, 5–7 or may be part of a one compartment system 10 as provided in FIG. 6. The important concept being that a parallelogram type structure is provided in order to mount hangers 12 and garments 14 in a manner such that a cascading effect of garments 14 are displayed to a user or customer viewing the displayed items. Additionally, another important aspect of improved display system 10 is that various supporting members of overall system 10 are transparent in nature such that a maximization of the visual sight line allows the customer to see a maximum number of garments 14 being displayed on system 10. Still further, by utilizing the transparent qualities of supporting members, hanger support devices may be mounted at different vertical heights in discrete compartment areas in order to further increase the variety of garments 14 being displayed.

Referring now to FIGS. 1 and 2 improved system 10 is shown to include three compartments 18, 20 and 22 for displaying garments 14 hung or removeably mounted therein. Each of compartments 18, 20 and 22 are formed of first display members 24, 26 and 28, each of which include a pair of first and second intersecting planar sections 30, 32; 34, 36; and 38, 40. Each of first and second planar sections 30, 32, 34, 36, 38 and 40 are generally planar in nature and extend in vertical direction 42 and are further adapted to be mounted on base surface 44 as will hereinafter be described. Each of first display members 24, 26 and 28 may be formed of a plastic material which is preferably transparent in order that a customer may see from one compartment 18, 20 or 22 to another compartment forming improved display system 10.

Associated planar sections 30, 32 and 24, 36 as well as 38, 40 as seen in FIGS. 1 and 2 are non-coplanar and provide for an included angle 46 between a respective set of first and second planar sections in order that each of first display members 24, 26 and 28 will be stabilized when resting on base surface 44.

Additionally, each of planar sections 30, 32, 34, 36 and 38, 40 may be formed in one piece construction in order to minimize the number of connecting elements that may be utilized in construction of first display members 24, 26 and 28.

In the embodiment shown in FIGS. 1 and 2, compartment 20 is formed of opposing parallel planar sections 30 and 36 which are positionally located in parallel relation each to the other. Planar sections 30 and 36 are coupled each to the other through hanger support device or rail member 16. Hanger support device 16 includes an extended length and is secured on opposing ends thereof to each of planar members 30 and 36. As will be shown in following paragraphs, hanger rails 16 are constructed to skew a plane of garment and associated garment hangers 14 and 12 with respect to the extended length of hanger rails 16 in order to provide the necessary cascading effect.

Opposing planar sections 30 and 36 provide for fixed boundary planes which act as fixed restraints on garments 14 to angle garments 14 in a manner somewhat parallel to planes 30 and 36. Thus hangers 12 and associated garments 14 are skewed with respect to rails 16 to provide the cascading effect to show increased garment surface area.

Hanger rails 16 as shown in FIGS. 1, 2 and 3 include support bar 48 which extends in a linear manner between each of planar members 30, 36 and 34, 38 as well as 40, 32. Support bars 48 are mounted in a manner to form acute angles 50 between the extended length of bars 48 and the plane of associated planar members such as 30 and 36 associated with compartment 20 as shown in FIG. 2.

Hanger or support bars 48 include a rectangular contour when taken in cross section with respect to the extended length of support bar 48. Additionally, support bars 48 may be formed of a steel construction having a chrome coating in order to give a more pleasing effect of the overall display system 10. However, the particular material construction of support bars 48 are not important to the inventive concept as is herein developed with the exceoption that support bars 48 must be of a rigid material sufficient in load carrying capability to provide a stable surface for garments 14 hung thereon.

Referring now to FIGS. 1, 2 and 3, it is clearly seen that hanger support device 16 includes a pair of planar mounting plates 52 and 54 secured to opposing ends of support bar 48. Mounting plates 52 and 54 may be secured to support bar 48 through welding, bolting or some like fastening technique not important to the inventive concept.

The important aspect of mounting plates 52 and 54 being that such plates form at least one acute angle 56 with respect to the extended length of support bar 48. Additionally, mounting plates 52 and 54 are aligned in parallel relation to respective planar members or sections such as 30 and 36 for compartment 20. Thus, from the construction geometry of hanger support device 16, it is seen that mounting plates 52 and 54 are mounted in parallel relation each with respect to the other on opposing ends of support bar 48.

When hanger support device 16 is mounted between parallel planar sections such as 30 and 36 for compartment 20; sections 34 and 38 for compartment 22; and, sections 40 and 32 for compartment 18, that such provides the necessary parallelogram construction for display system 10 which provide for the cascading effect when garments 14 are mounted thereon.

Each of mounting plates 52 and 54 further includes associated mounting plate openings 56 and 58 to permit passage therethrough of mounting bolts 60 and 62. External plates 64 and 66 are mounted on external surfaces of associated planar sections such as 30 and 36, and are adapted to receive bolt members 60 and 62 for securement of hanger support device 16 to associated planar members. Threaded securement in fixed fashion is provided by passage of bolts 60 and 62 into associated threaded nut members 68 and 70.

Thus, each of planar sections such as section 30 of compartment 20 is mounted in sandwich fashion between an associated mounting plate 58 and external plate 66 secured to an opposing external surface of planar section 30. In a similar fashion, planar section 36 is sandwiched between mounting plate 56 and external plate 64 through threaded securement by bolt members 60.

Acute angles 50 are substantially equal to the included angles 46 as shown in FIG. 2 to provide the overall parallelogram type construction geometry of improved display system 10.

Bolt members 60 and 62 passing through mounting plate openings 56 and 58 also pass through planar section openings 72. As is seen in FIG. 1, a plurality of vertically directed openings 72 may be included in planar sections 30, 32, 34, 36, 38 and 40 in order to mount different support bars 48 associated with compartments 18, 20 and 22 in vertically displaced locations with respect to each other. This permits support bars 16 associated with different compartments 20, 22 and 18 to be mounted in vertically displaced relation each with respect to the other. In this manner, it is seen that garments 14 hung in different compartments may be visible to a customer thereby increasing the display variety seen by the viewer.

In FIGS. 1 and 4 there is seen base plate mount 74 which includes a pair of planar arm members 76 and 78 formed in one piece construction and having an included angle 80 which is formed to sum to 180° when taken in addition to acute or included angle 46 of associated planar members of first display members 24, 26 and 28. Each of arm members 76 and 78 include through openings 82 and 84 in order to pass therethrough bolt members 86 and 88. Planar sections such as 30 and 36 are sandwiched between associated arm members 76 as shown in FIG. 4, and are joined through threaded nuts 90 and 92 to provide a more secure base when a set of compartment members 18, 20 and 22 are mounted each to the other to provide improved display system 10.

Shown in FIG. 6 is improved display system 10 in a basic formation having a pair of displaced planar members 94 and 96 positionally located parallel each to the other. In the same manner as has hereinbefore been provided parallel planar members 94 and 96 are joined through support bar 48 which is structurally secured to opposing mounting plates 52 and 54 as has hereinbefore been described to provide an included angle 50 between the extended length of support bar 48 and opposing parallel displaced plates 94 and 96. The included angle 50 permits the mounting of garments 14 to provide the cascading effect and maximize the viewing surface of garments 14 hung on support bar 48.

Referring now to FIGS. 5 and 7, there is seen a number of embodiments of system 10 which utilize the parallelogram construction as has hereinbefore been provided. Referring to FIG. 5, there is shown a configuration for improved display system 10 which includes compartments 100, 102, and 104. Garment compartment 100 has a pair of first display members 106 and 108 which are formed of respective planar members 110, 112, 114 and 116. Planar members 110, 112, and 114, 116 are joined each to the other in a non-coplanar manner to provide obtuse angle 118 formed therebetween. As is seen in FIG. 5, planar section 110 is displaced and is in parallel relation to planar section 114. In a similar manner, planar section 112 is parallel to planar section 116 of display member 106. Support bars 48 join opposing planar sections 112 and 116 and 110 to 114 as is shown. In the configuration shown in FIG. 5 an additional planar section 120 is mounted to planar section 116 of compartment 100 to form a second compartment 102.

Compartment 102 may be formed by joining planar section 120 to planar section 116 through a base mounting plate 74 such as that shown in FIG. 4. Base mounting plate 74 secures planar sections 116 and 120 in a manner to provide obtuse angle 118 which is equal to obtuse angle 120 formed in U section display member 122. U-shaped display member 122 includes opposing parallel plane sections 124 and 126 each of which are joined to the other by support bar 48 to provide compartment 104.

FIG. 7 provides for another configuration of improved display system 10 including a mode of joining displaced parallel sections to provide five compartments 124, 126, 130 and 132. In this embodiment of improved display system 10 a pair of U-shaped section members 134 are used in conjunction with radially extending planar sections 136, 138 and 140 each joined to the other through respective mounting plates 74 and adapted to provide parallel planar surfaces displaced each from the other and joined by appropriate support bars 48.

While this invention has been described in connection with preferred specific embodiments thereof, it will be understood that this description is intended to illustrate but not limit the scope of the invention which is defined by the appended claims.

What is claimed is:

1. A display system for receiving garment hangers having garments mounted thereon, comprising:

(a) a first display member having at least a pair of first and second intersecting planar sections, said pair of sections being non-coplanar;

(b) a second display member having at least a pair of first and second intersecting planar sections, one of said intersecting planar sections of said first display member being positioned parallel one of said planar sections of said second display member; and;

(c) hanger support means having an extended length and secured on opposing ends thereof to each of said parallel sections of said first and second display members, said hanger support means forming an acute angle between said extended length and the plane of each of said parallel planar sections.

2. The display system as recited in claim 1 where said first and second display members are formed of a substantially transparent material.

3. The display system as recited in claim 1 where each of said first and second display members are formed in one-piece construction.

4. The display system as recited in claim 1 where said hanger support means includes a hanger support bar extending in a linear manner between a pair of parallel displaced planar sections of said first and second display member, said support bar forming an acute angle between said extended length and the plane of each of said parallel displaced planar sections.

5. The display system as recited in claim 4 where said hanger support bar includes a rectangular contour taken in cross-section with respect to said extended length of said hanger support bar.

6. The display system as recited in claim 4 including a base plae element secured to one of said planar sections of said first display member and to one of said planar sections of said second display member on opposing ends thereof for constraining said first and second display member in relation each to the other.

7. The display system as recited in claim 4 where said hanger support bar includes a pair of planar mounting plates secured to said opposing ends of said support bar, said planes of said mounting plates formed at least one acute angle with respect to said extended length of said supporting bar.

* * * * *